United States Patent [19]

Wormser

[11] 4,094,503

[45] June 13, 1978

[54] PLAYGROUND SWING WITH EXTRUDED CROSSBAR

[76] Inventor: Robert S. Wormser, 6900 SW. 19th Ave., Ocala, Fla. 32670

[21] Appl. No.: 782,892

[22] Filed: Mar. 30, 1977

[51] Int. Cl.[2] ..... A63G 9/00

[52] U.S. Cl. ..... 272/85; 428/596; 248/341; 297/273

[58] Field of Search ..... 272/85, 86, 87, 88, 272/89, 90, 91, 92; 29/183; 248/17, 317, 340, 341, 370, 163; 297/273, 282

[56] References Cited

U.S. PATENT DOCUMENTS

| | | | |
|---|---|---|---|
| 2,638,967 | 5/1953 | Morton, Jr. et al. | 273/85 |
| 2,757,714 | 8/1956 | Hurley | 272/89 |
| 3,145,024 | 8/1964 | Grudoski | 272/87 |

*Primary Examiner*—Richard C. Pinkham
*Assistant Examiner*—T. Brown
*Attorney, Agent, or Firm*—Beaman & Beaman

[57] ABSTRACT

A playground swing crossbar comprises a tubular extrusion having an upper portion, preferably of polygonal transverse cross section, and a lower portion of reduced dimension which is notched at its lowermost end to receive swing hangers. A rod received within a cavity defined in the lower portion pivotally supports the hangers, and caps located at the crossbar ends restrain the rod from longitudinal displacement. Recessed flat surfaces defined on the upper portion permit leg column sockets to be readily positioned and welded to the upper portion, and an embodiment of the crossbar permits spacers to be interposed between crossbars in a swing utilizing double crossbars.

12 Claims, 6 Drawing Figures

PLAYGROUND SWING WITH EXTRUDED CROSSBAR

BACKGROUND OF THE INVENTION

The invention pertains to playground swings, and particularly relates to the swing crossbar construction.

Playground swings basically consist of a crossbar supported upon leg columns wherein the swings depend from the crossbar. Conventionally, the crossbar consists of a tube or conduit, usually pipe, and a variety of fittings are available whereby the legs and swing hangers or pendents are attached to the crossbar. These fittings are often of the stamped type utilizing semicylindrical clamping surfaces or split rings adapted to engage the pipe exterior surface and are closed by bolts wherein the crossbar is grasped by the leg or swing hanger fitting.

The fittings for the leg columns usually include sockets which are bolted to the tubular crossbar and the fittings for the swing hangers are usually of the semicircular type including a yoke or bracket to which the swing hanger may be pivotally mounted.

Conventional playground swing fittings have the disadvantage of requiring expensive tooling, resulting in relatively high cost, and the known modes of assembly to the crossbar require a degree of expertise on the part of the installer. Further, conventional swing fittings are unattractive and, as they use threads and bolts to maintain the fittings in a clamped condition, it is not ususual for the bolts to become loosened over a period of time due to vibration, creating a dangerous condition wherein a leg column, or swing fitting, may inadvertently become disassembled permitting collapse of the apparatus.

SUMMARY OF THE INVENTION

It is an object of the invention to provide a playground swing with a crossbar of extruded manufacture wherein a high degree of strength is achieved with a minimum of material and the fittings required with the crossbar are substantially reduced in number from conventional playground swing constructions and portions of the fittings may be preattached to the crossbar at the factory.

An additional object of the invention is to provide a playground swing construction wherein the crossbar is of such fabrication as to be aesthetically attractive and "clean" in appearance.

A further object of the invention is to provide a playground swing crossbar construction wherein assembly of the swing is simplified with respect to prior requirements, and the number of components required for assembly of the swing is significantly reduced.

In the practice of the invention the swing crossbar is formed of a metal extrusion having a uniform transverse cross section throughout its length. The crossbar includes an upper portion, preferably having a polygonal cross section of either four or five sides, and the extrusion includes a homogeneous lower portion of reduced transverse dimension which cooperates with the swing hangers or pendents.

Both the upper and lower crossbar portions are hollow and a hanger rod is received within the lower portion wherein the notching of the lower portion to receive swing hangers permits the rod to be inserted through the pivot support bore of the hangers and pivotally mount the hangers to the crossbar. In this manner the pivot rod, and upper portion of the hanger, are within the confines of the crossbar, resulting in a clean, attractive appearance.

The upper portion of the crossbar includes flat sides and the two sides adjacent the lower portion are provided with recessed panels defined by lateral shoulders wherein metal sockets of a width equal to the recesses may be readily located therein and welded to the crossbar for reception of the leg columns at the site of use.

In an embodiment of the invention the crossbar upper portion includes five sides, two of the sides being vertically oriented during use, whereby spacing members may be interposed between the vertical sides of dual crossbar swing installations.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
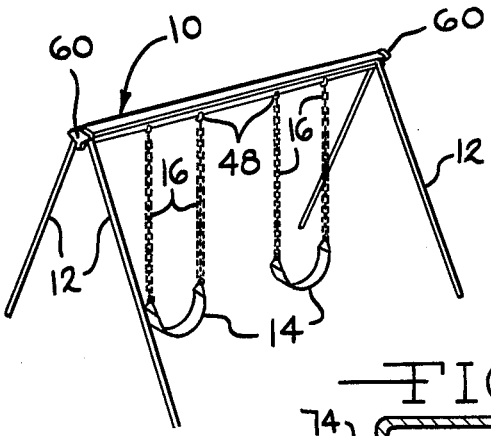
FIG. 1 is a perspective view of a typical playground swing using the crossbar of the invention.

With reference to FIG. 1, a typical playground swing assembly utilizing the concepts of the invention employs a crossbar 10 supported in a horizontal manner above the ground by converging leg columns 12 attached to the crossbar. Swings 14 are supported from the crossbar and include a seat attached to the lower ends of chains 16 pivotally connected to the crossbar.

Figure 2:
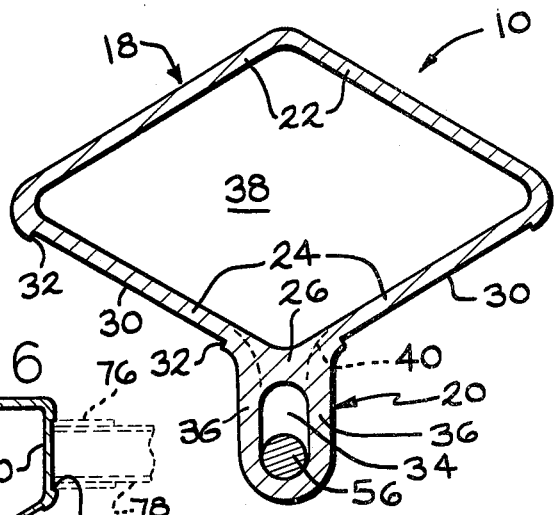
FIG. 2 is an elevational, cross-sectional view of the crossbar taken along section II—II of FIG. 3.

The swing crossbar 10 consists of an extrusion having a cross section which will be apparent from FIG. 2. Usually, the crossbar 10 wll be formed of aluminum and, as appreciated from FIG. 2, the extrusion basically comprises a primary upper portion 18, and a smaller lower portion 20. The configuration shown in FIG. 2 illustrates a typical cross section for use with single crossbar swings and the upper portion 18 constitutes a polygonal of four-sided configuration, including upper sides 22 and lower sides 24. The sides 24 intersect at 26, and the lower portion 20 depends downwardly from this intersection. The sides 24 are each formed on their exterior surface with an elongated recessed panel 30 which is planar in configuration and laterally defined by right angle shoulders 32. The purpose of these panels will be later described.

The crossbar lower portion 20 is of a width substantially less than the width of the upper portion 18, as viewed in FIG. 2, and a chamber or cavity 34 is formed within the portion 20 defining parallel walls 36. While in the drawings the cavity 34 is separate from the cavity 38 of the upper portion 18, it is within the concept of the invention to form the extrusion with a single cavity wherein the material of the intersection 26 can be eliminated as indicated by dotted lines 40.

The crossbar 10 is supported by leg columns 12, and the leg columns are received within annular cylindrical sockets 42 welded to the crossbar adjacent the ends thereof, as will be appreciated from FIG. 1. The sockets 42 are of an outer diameter substantially corresponding to the spacing between the shoulders 32 of the recessed panels 30 whereby locating the sockets on the panels is facilitated prior to welding. Once the sockets 42 are located on the panels 30, as desired, they are permanently attached to the crossbar by a weld bead as represented at 44, FIG. 4.

Figure 4:
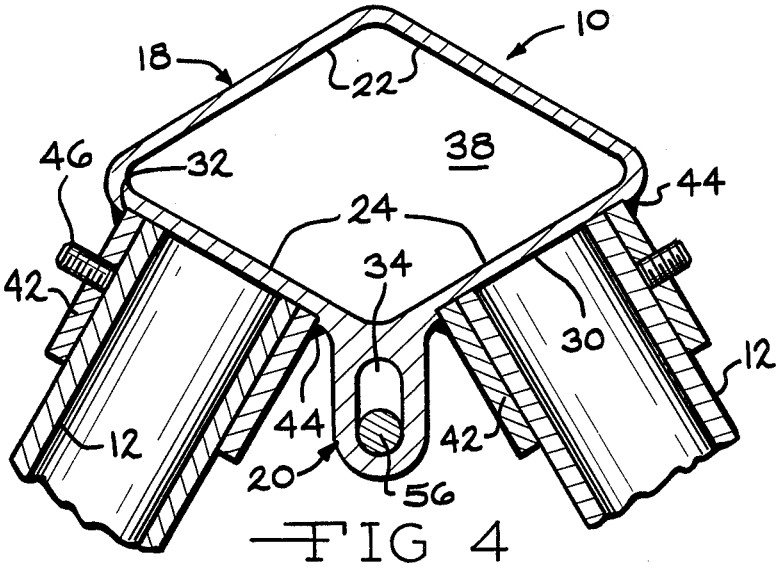
FIG. 4 is an elevational, sectional, detail view as taken along section IV—IV of FIG. 3.

Each socket 42 may include one or more set screws 46 whereby, upon insertion of the cylindrical leg columns 12 into the sockets, as apparent in FIG. 4, the tightening of the set screws 46 will maintain the leg columns therein.

For stability purposes, the leg columns 12 diverge in a downward direction, and the angular relationship of the extrusion body sides 24 will insure an orientation of the sockets which properly positions the leg columns to the crossbar.

Figure 3:
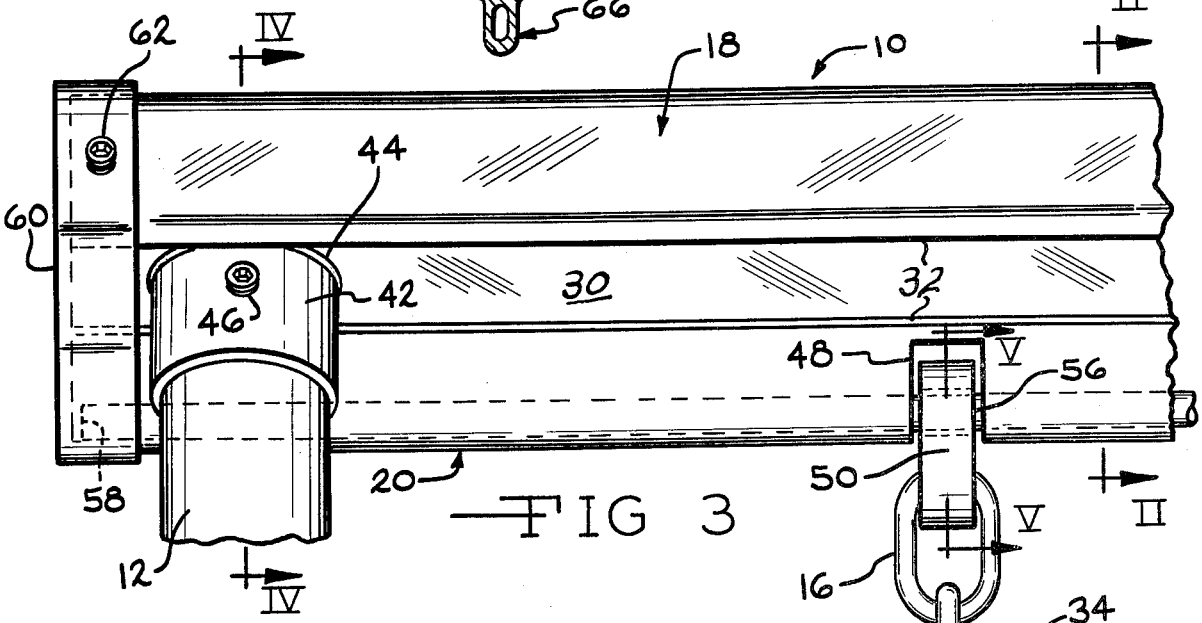
FIG. 3 is a partial, elevational view of the end of a playground swing crossbar employing the inventive concepts.
Figure 5:
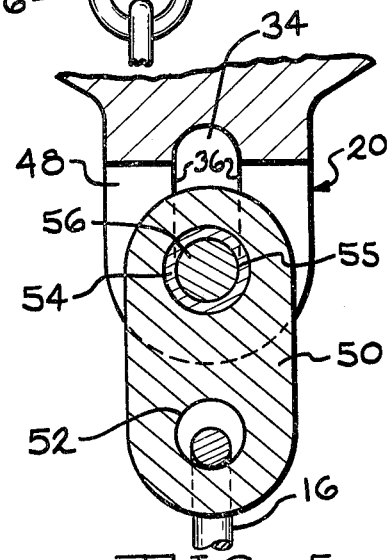
FIG. 5 is an enlarged, detail, sectional view taken through a swing hanger along section V—V of FIG. 3.

The crossbar lower portion 20 is notched at 48 at a plurality of locations, FIGS. 3 and 5, whereby the notches extend upwardly from the lowermost edge of the portion 20 a sufficient distance to intersect much of the cavity 34 and provide adequate clearance for the swing hanger 50 located therein. The notches 48 may be cut into the crossbar 10 at the factory, or at the site, and will be located at a distance from the leg columns 12, as desired, and the notches associated with the chains or hangers of a common swing will be axially spaced apart a distance determined by the width of the swing seat. The notches 48 are of an axial dimension slightly greater than the thickness of the swing hangers 50 whereby the swing hangers will not interfere with the notch edges during swing operation.

The swing hangers or pendents 50 may take a variety of forms and the form illustrated is of a simplified configuration whereby the hanger includes a lower hole 52 to which the swing chain 16 is attached. The upper portion of the hanger includes a tubular sleeve bearing 54 of copper or bronze having a bore 55.

The hangers 50 are maintained within the notches 48 by the cylindrical rod 56 located within the lower portion cavity 34. The rod 56 is of a length substantially equal to the length of the crossbar 10 having ends 58, FIG. 3, and rests in the lower portion of the complimentarily shaped cavity 34, as appreciated from FIGS. 2 and 4. The diameter of the rod 56 substantially corresponds to the diameter of the bearing bore 55 and the transverse dimension of the cavity 34 is only slightly greater than the diameter of the rod 56 whereby the walls 36 restrain the rod against movement in a direction transverse to the crossbar length.

The ends of the crossbar 10 are enclosed by caps 60 attached to the crossbar ends and maintained thereon by at least one set screw 62. The configuration of the cap corresponds to that of the crossbar and, it will be appreciated that by employing a cap 60 at each crossbar end that the caps will prevent longitudinal displacement of the rod 56, since the rod is of a length substantially corresponding to that of the crossbar.

To assemble a swing in accord with the concepts of the invention, the installer merely inserts the leg columns 12 into the sockets 42 since, in most instances, the sockets have been welded upon the crossbar at the factory. Tightening of the set screws 46 permits the crossbar to be supported in its elevated operating condition and, as the caps 60 have not yet been placed upon the crossbar, the rod 56 may be inserted into the cavity 34 and pushed therethrough. As the rod is pushed through the cavity 34 a hanger 50 is located within the immediate notch approached by the forward end of the rod, and the bearing bore 55 is aligned with the rod for insertion therethrough. After all the hangers 50 have been placed upon the rod 56 the rod will be longitudinally located within the confines of the crossbar portion 20, and the caps 60 are placed in position and the set screws 62 thereof tightened. The assembly is then complete.

It will be appreciated that since the rod 56, and the upper portions of the hangers 50, are within the confines of the crossbar lower portion 20 and, as the sockets 42 are welded to the crossbar, rather than bolted thereto, that a swing constructed in accord with the concepts of the invention is of an unusually clean and uncluttered appearance and, as the set screws 46 and 62 will not be subjected to high stresses, the likelihood of the set screws loosening is reduced. Thus, a swing constructed in accord with the invention requires a minimum of maintenance and will remain in a safe condition for extended periods of time.

In playground swing devices which utilize elongated seats wherein the rider employs a pumping action to produce swinging, or wherein the seat employs three or four supporting chains, it is known to use a double crossbar arrangement wherein a pair of crossbars may be disposed in parallel, side-by-side arrangement spaced apart 2 or 3 feet. The inventive concepts may be utilized in such a swing installation by employing the extruded crossbar configuration shown in FIG. 6. In this embodiment the upper portion 64 includes five sides while the lower portion 66 is identical to that previously described. The lower sides 68 are employed in a manner similar to the sides 24 previously described to which leg column sockets, not shown, may be welded. However, the sides 70 are so disposed as to be located within vertical planes during swing use, and the sides 70 include recessed panels 72 defined by shoulder edges 74. A socket 76 may be welded to a side 70 received within the recessed panel and a spacer tube 78 may be received within the socket. A set screw, not shown, may be mounted on the socket 76 for affixing the spacer tube 78 therein.

Figure 6:
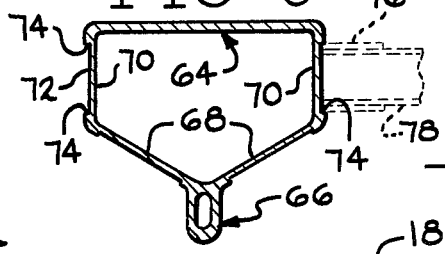
FIG. 6 is an elevational, transverse, cross-sectional view of a variation in playground swing crossbar configuration.

With respect to the embodiment of FIG. 6, it is also possible to directly weld the spacer tube 78 to a panel 72 at the factory and, in such instance, the socket 76 may be eliminated. It will be appreciated that in a double crossbar swing the spacer tubes 78 will be affixed to the other crossbar, not shown, in like manner, and the tubes 78 will be spaced along the crossbar as needed to provide the desired strength and bracing.

It will be appreciated that the use of extrusions in a swing crossbar permits an interrelationship and appearance not heretofore achievable and it is appreciated that various modifications to the inventive concept may be apparent to those skilled in the art without departing from the spirit and scope of the invention.

I claim:

1. In a playground swing including a crossbar supported upon leg columns affixed to the crossbar and angularly extending therefrom and swing members suspended from the crossbar having hanger members pivotally connected thereto, the improvement comprising said cross bar constituting an elongated hollow body having ends, an interior cavity, exterior sides to which the leg columns may be attached and a lower portion, said lower portion also having an interior cavity extending longitudinally therealong, an elongated pivot rod within said cavity of said body lower portion, rod restraining means within said body cavity engaging said rod preventing lateral rod displacement within said body lower portion cavity, a plurality of transverse notches defined in said body lower portion intersecting said cavity, said rod extending across said notches, and swing hanger members received within said notches pivotally mounted upon said rod.

2. In a playground swing as in claim 1 wherein said rod includes ends and is of a length substantially equal to the length of said crossbar, and caps affixed to said crossbar ends enclosing said interior cavity and restricting said rod against longitudinal displacement.

3. In a playground swing as in claim 1, wherein said crossbar body exterior sides include a pair of flat panels adjacent said lower portion and angularly related to each other, and leg column mounting means mounted on said panels.

4. In a playground swing as in claim 1 wherein said crossbar body comprises a metal extrusion having a uniform cross section throughout its length.

5. In a playground swing as in claim 4 wherein said crossbar body extrusion includes an upper portion and a downwardly extending lower portion of lesser transverse dimension than said upper portion, said exterior sides to which said leg columns may be attached being defined on said upper portion.

6. In a playground swing as in claim 5 wherein said crossbar body lower portion comprises a hollow elongated projection.

7. In a playground swing as in claim 5 wherein said upper portion is of a polygonal transverse cross section having a plurality of flat sides and said lower portion extends from an intersection of first and second flat sides, said first and second sides including flat recessed panel surfaces angularly disposed to each other for receiving leg column sockets.

8. In a playground swing as in claim 7 wherein said upper portion includes at least one additional side panel having a flat recessed panel surface substantially parallel to the downward extension of said lower portion relative to said upper portion whereby said at least one side panel is vertically disposed during use and receives a crossbar spacer means.

9. A crossbar for playground swings comprising a hollow metal extrusion having a primary upper portion and a lower portion of reduced transverse dimension with respect to said upper portion, a longitudinal cavity within said lower portion for receiving a swing hanger supporting rod, and longitudinal spaced notches defined in said lower portion intersecting said cavity adapted to receive a swing hanger.

10. In a crossbar for playground swings as in claim 9 wherein said upper portion is of a polygonal transverse cross section including a plurality of sides, first and second adjacent sides defining an intersection at the lowermost location of said upper portion and angularly related to each other, said lower portion depending from said intersection and including spaced parallel walls defining said cavity.

11. In a crossbar for playground swings as in claim 10 wherein said first and second sides include flat recessed panel surfaces defined on the exterior thereof, said flat surfaces being laterally defined by shoulder surfaces.

12. In a crossbar for playground swings as in claim 10 wherein said upper portion includes at least one additional side lying in a substantially vertical plane when said crossbar is in use.

* * * * *